US008800641B2

(12) United States Patent
Jacobsen et al.

(10) Patent No.: US 8,800,641 B2
(45) Date of Patent: Aug. 12, 2014

(54) METHODS AND APPARATUS FOR A MICRO-TRUSS BASED STRUCTURAL INSULATION LAYER

(75) Inventors: Alan Jon Jacobsen, Woodland Hills, CA (US); Stephen Edward Lehman, Golden Eagle, IL (US); Geoffrey P. McKnight, Los Angeles, CA (US); William Bernard Carter, Woodland Hills, CA (US)

(73) Assignee: The Boeing Company, Chicago, IL (US)

( * ) Notice: Subject to any disclaimer, the term of this patent is extended or adjusted under 35 U.S.C. 154(b) by 515 days.

(21) Appl. No.: 12/476,003

(22) Filed: Jun. 1, 2009

(65) Prior Publication Data

US 2010/0300669 A1 Dec. 2, 2010

(51) Int. Cl.

| | |
|---|---|
| ***F28F 7/00*** | (2006.01) |
| ***F28F 3/12*** | (2006.01) |
| ***B64C 1/38*** | (2006.01) |

(52) U.S. Cl.

USPC ..... 165/136; 165/168; 165/169; 244/117 A

(58) Field of Classification Search

USPC ..... 165/104.31, 168, 169; 428/116, 119, 428/86, 304.4, 608, 598, 596; 239/127.1

See application file for complete search history.

(56) References Cited

U.S. PATENT DOCUMENTS

| | | | | | |
|---|---|---|---|---|---|
| 3,161,478 | A | * | 12/1964 | Chessin | 428/613 |
| 3,365,897 | A | * | 1/1968 | Middleton et al. | 62/45.1 |
| 3,489,206 | A | * | 1/1970 | LeCourt | 165/47 |
| 3,493,177 | A | * | 2/1970 | Bromberg et al. | 239/13 |
| 3,668,880 | A | * | 6/1972 | Gille | 62/45.1 |
| 3,692,637 | A | * | 9/1972 | Dederra et al. | 205/114 |
| 4,108,241 | A | * | 8/1978 | Fortini et al. | 165/146 |
| 4,482,111 | A | * | 11/1984 | Le Touche | 244/117 A |
| 4,492,088 | A | * | 1/1985 | Ibrahim et al. | 62/50.7 |
| 4,592,950 | A | * | 6/1986 | Le Touche | 442/283 |
| 5,226,299 | A | * | 7/1993 | Moiseev | 62/45.1 |
| 5,267,611 | A | * | 12/1993 | Rosenfeld | 165/168 |

(Continued)

FOREIGN PATENT DOCUMENTS

EP 0646719 A1 4/1995

OTHER PUBLICATIONS

Esgar, J.; Turbine Cooling—Its Limitations and Its Future; Technical Paper proposed for presentation at Thirty-Sixth Meeting of the AGARD Propulsion and Energetics Panel on High Temperature Turbines, Florence, Italy, Sep. 21-25, 1970; NASA; 27 pages.

U.S. Appl. No. 11/801,908, filed May 10, 2007.

(Continued)

*Primary Examiner* — Allen Flanigan
*Assistant Examiner* — Jason Thompson
(74) *Attorney, Agent, or Firm* — Armstrong Teasdale LLP

(57) ABSTRACT

An apparatus for maintaining a temperature differential between a component and a source of heat is described. The apparatus includes a micro-truss structure having a plurality of nodes and members which define a first surface and a second surface. The second surface is operable for attachment to the component. The apparatus further includes a skin material attached to the first surface of the micro-truss structure such that the skin material is operable for placement between the heat source and the micro-truss structure. The skin material defines at least a portion of a fluid flow path through the micro-truss structure. A skin material is not utilized with certain configurations of the micro-truss structure.

4 Claims, 4 Drawing Sheets

(56) References Cited

U.S. PATENT DOCUMENTS

| | | | | |
|---|---|---|---|---|
| 5,509,472 | A * | 4/1996 | Tamura et al. | 165/171 |
| 5,720,434 | A * | 2/1998 | Vdoviak et al. | 239/127.1 |
| 7,232,093 | B2 | 6/2007 | Behrens et al. | |
| 7,382,959 | B1 | 6/2008 | Jacobsen | |
| 7,401,643 | B2 * | 7/2008 | Queheillalt et al. | 165/104.21 |
| 7,963,085 | B2 * | 6/2011 | Sypeck et al. | 52/782.1 |
| 2002/0170941 | A1 | 11/2002 | Wallach et al. | |
| 2004/0222571 | A1 * | 11/2004 | Steffier | 264/602 |
| 2004/0245373 | A1 | 12/2004 | Behrens et al. | |
| 2005/0257919 | A1 * | 11/2005 | White | 165/104.31 |
| 2006/0080835 | A1 | 4/2006 | Kooistra et al. | |
| 2007/0074853 | A1 * | 4/2007 | Popovich | 165/80.4 |
| 2007/0246191 | A1 * | 10/2007 | Behrens et al. | 165/80.4 |
| 2007/0262201 | A1 * | 11/2007 | Cox et al. | 244/126 |
| 2008/0105402 | A1 | 5/2008 | Behrens et al. | |

OTHER PUBLICATIONS

U.S. Appl. No. 12/008,479, filed Jan. 11, 2008.
U.S. Appl. No. 12/074,727, filed Mar. 5, 2008.
International Search Report and Written Opinion for PCT/US2010/033725; Nov. 29, 2010; 12 pages.
International Search Report for PCT/US2010/033725; Oct. 6, 2010; 6 pages.

* cited by examiner

METHODS AND APPARATUS FOR A MICRO-TRUSS BASED STRUCTURAL INSULATION LAYER

BACKGROUND

The field of the invention relates generally to cooling of structures, and more specifically, to methods and apparatus for a micro-truss based structural insulation layer.

Multiple solutions have been utilized in thermal protection of structures. Many of these solutions include low density core materials as a part of the structure, which allow air to pass through while also providing an insulation factor. These core materials include one or more of carbon foam, silicon carbide foam, alumina tile, and slotted honeycomb. Other core materials may be known.

Ceramic foams have been used for thermal protection systems and heat exchanger applications. However, due to their random foam cell orientation, they are not as mechanically efficient as is desired. Also, the random foam cell orientation results in some degree of difficulty, when attempting to pass forced air through the foam. In addition, the random reticulated foam also provides limited design variables (primarily foam cell size) for optimizing these foam structures from a thermal-mechanical performance perspective.

One solution incorporates a ceramic thermal protection system, in which the ceramic is porous, allowing cooling air to pass therethrough. However, this porous ceramic has many of the same features as does the reticulated foam. Specifically, the randomness of the individual cells results in inefficient air passage through the ceramic.

BRIEF DESCRIPTION

In one aspect, an apparatus for maintaining a temperature differential between a component and a source of heat is provided. The apparatus includes a micro-truss structure having a plurality of nodes and members which define a first surface and a second surface. The second surface is operable for attachment to the component. The apparatus further includes a skin material attached to the first surface of the micro-truss structure such that the skin material is operable for placement between the heat source and the micro-truss structure. The skin material defines at least a portion of a fluid flow path through the micro-truss structure.

In another aspect, a structure for protecting a surface from heat fluctuations emanating from a heat source is provided. The structure includes a micro-truss structure having a plurality of hollow members intersecting at nodes. The hollow members define a first surface and a second surface and a plurality of spaces therebetween. The second surface is configured for placement proximate the surface that is to be protected from the heat source, while the hollow members and nodes are configured such that a fluid flow may be directed therethrough. The structure further includes an insulating material filling the spaces defined by the hollow members and the nodes of the micro-truss structure.

In still another aspect, a method for insulating a surface from a source of heat that is proximate the surface is provided. The method includes attaching a micro-truss structure to the surface, the micro-truss structure between the surface and the source of heat, and associating a fluid flow with the micro-truss structure such that operation of the fluid flow removes heat from an area associated with the micro-truss structure.

The features, functions, and advantages that have been discussed can be achieved independently in various embodiments of the present invention or may be combined in yet other embodiments further details of which can be seen with reference to the following description and drawings.

DETAILED DESCRIPTION

The described embodiments relate to a thermal insulation structural element having a truss structure therein. In various embodiments, the truss structure includes a plurality of members extending from a node and attached to a skin surface. In certain embodiments, the truss structure and its members are ceramic. In certain embodiments, the truss members are hollow. With regard to both hollow and non-hollow truss embodiments, an overall structure may include a skin and one surface of the truss structure attached to the skin. An opposite surface of the truss structure is attached to a surface that is to be protected from heat flux. With the truss structure between the skin and the surface, a fluid flow path is formed that allows for a less constricted air flow across the truss structure.

One purpose of the described structures is to maintain a thermal differential ($\Delta T$) between a surface and an incident heat flux. An ability to adjust the flow of cooling air through the structure of the micro-truss enables control of the surface temperature. Several advantages of such a micro-truss structure include a variety of material options, such as ceramics and metals, a potential for net shape fabrication, no additional machining operations for cooling air flow channels, and the micro-truss architecture is capable of providing additional structural functionality.

One identified application for the below described embodiments, is in the environment associated with an aircraft exhaust nozzle. However, other applications that require surface temperature control are certainly contemplated.

Figure 1:
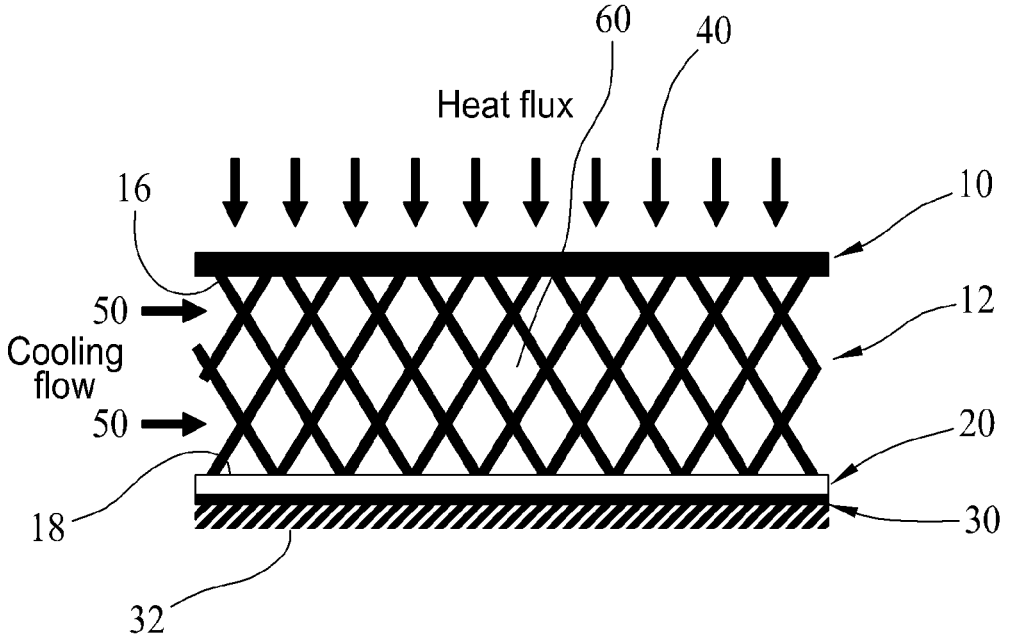
FIG. 1 is a cross sectional view of a micro-truss based actively cooled insulation layer that includes an impermeable skin.

More specifically, the truss structure relates to embodiments of a micro-truss that are attached to a surface requiring protection from a high heat flux source. Referring to FIG. 1, a skin material 10 is attached to a micro-truss structure 12 along a first surface 16 of the micro-truss structure 12. A second surface 18 of micro-truss structure 12 is attached, using an attachment 20, such that the second surface 18 of micro-truss structure 12 is adjacent a surface 30 of a device, or substructure 32, that is to be protected from heat flux 40. In the illustrated embodiment, the surface 30 of the substructure 32 is protected from the high heat flux 40 by convective cooling that is provided by cooling air 50 passing through the micro-truss structure 12. One purpose of the skin 10 is to enclose an interior region 60 of the micro-truss structure 12 to allow for the flow of cooling air 50.

As described elsewhere herein, micro-truss structure 12 may be fabricated from a polymer, a metal (or alloy), or from a ceramic material. For temperatures exceeding approximately 200 degrees Celsius, micro-truss materials must be converted to either a metal or a ceramic. One preferred embodiment utilizes a ceramic micro-truss. Silicon carbide and alumina are two examples of such a ceramic, though there are others. The reasons are many, and include: because ceramic materials are generally lower density than metals, because ceramic materials are generally more thermally stable in higher temperature environments, and because ceramic materials generally have a lower thermal conductivity, which inhibits the conduction of heat through the truss members to the surface that requires protection from the heat flux.

In the case of the impervious skin material 10, incident thermal energy conducts through the material from which the members of micro-truss structure 12 are fabricated towards the surface 30 requiring protection from the high heat flux 40. Cooling air 50 is directed through the micro-truss structure, providing a convective cooling mechanism to maintain a desired ΔT. One embodiment of an impervious skin material is a ceramic fiber reinforced ceramic matrix composite (CMC).

For the impervious skin material 10, the temperature of the cooling air 50 directed through the micro-truss structure 12 will increase as the cooling air 50 removes heat from the individual members of micro-truss structure 12. This phenomenon reduces the efficiency of the cooling air 50 as the effective path length through the micro-truss structure increases, due to a decreasing temperature differential between the cooling air 50 and the skin material(s) 10. Limitations on the cooling air flow rate will ultimately determine if this cooling mechanism is sufficient to maintain a safe ΔT for the required temperature conditions in a specific application.

As shown in FIG. 1 and in subsequent figures, the micro-truss structure 12 is attached to the surface 30 requiring protection from the high heat flux 40. Bonding or mechanical attachment approaches may be utilized. In one preferred embodiment, the micro-truss structure 12 is attached to the surface 30 with a high temperature silicone adhesive, which provides an efficient strain relief layer. If a lower thermal gradient were expected at the bonding surface, other commercially available bonding approaches could be utilized.

Figure 2:
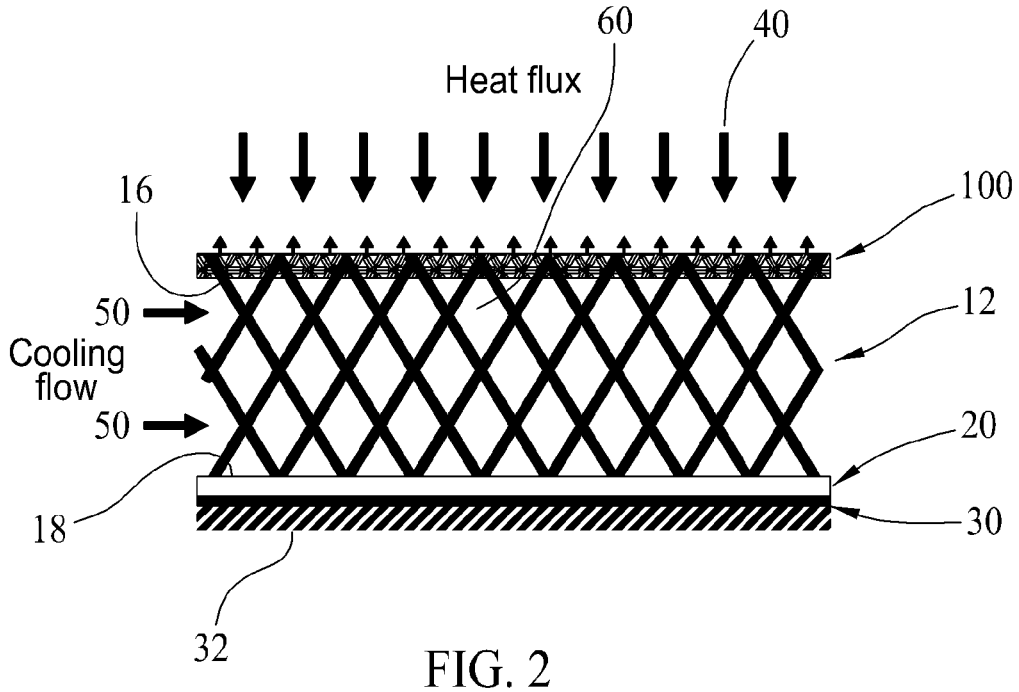
FIG. 2 is a cross sectional view of a micro-truss based actively cooled insulation layer that includes a porous skin.

As is the case with other embodiments described herein, a temperature differential between the skin material 10 and the surface 30 is controlled/maintained by passing the cooling air 50 through the natural flow channels of the structure associated with micro-truss structure 12. In addition, and as shown in FIG. 2, a skin material 100 may be porous, enabling cooling air to flow from the interior region 60 of the micro-truss structure 12, through a porous skin material 100, and onto the high heat flux 40, providing a transpiration mechanism. In the illustrated embodiment, the surface 30 of the substructure 32 is protected from the high heat flux 40 by convective cooling of the micro-truss structure 12 and transpiration cooling at the surface 102 of skin 100.

As one described embodiment, transpiration cooling can be achieved by utilizing a porous skin material 100 that will enable the cooling air 50 to "transpire" from the interior region 60 of the micro-truss structure 12 towards the direction of the incident heat flux 40. This active cooling mechanism reduces the skin temperature for a given heat flux (compared to an impervious skin material with a similar thermal conductivity), thus reducing the amount of heat conducted through the truss members. Examples of porous skin materials 100 include sintered particles and/or fibers that create an open porosity of >10%. In the case of a porous ceramic skin material, the particles and/or fibers may be comprised of oxide or non-oxide constituents.

Figure 3:
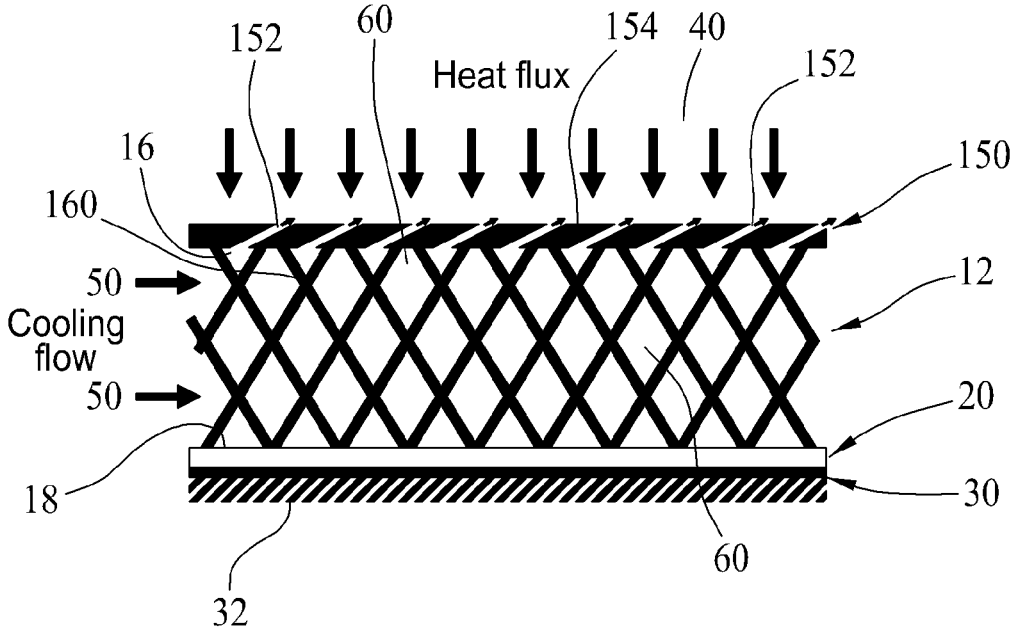
FIG. 3 is a cross sectional view of a micro-truss based actively cooled insulation layer that includes directional cooling holes incorporated into a skin.

FIG. 3 illustrates that the skin material 150 may be fabricated to include a plurality of aligned holes 152 that enable cooling air 50 to flow from the interior region 60 of the micro-truss structure 12, through the aligned holes 152, towards the heat source 40 providing a film cooling mechanism. The other aspects of this configuration are as before, specifically, the surface 30 of the substructure 32 is also protected from the high heat flux 40 by convective cooling of the micro-truss structure 12 and by film cooling at the surface of skin 150.

In one embodiment, and as illustrated in FIG. 3, skin material 150 may include an array of directional cooling holes 152 to accomplish the above mentioned film cooling: In alternative embodiments, the material for skin material may be the impervious skin material 10 described with respect to FIG. 1, or may the porous skin material 100 described with respect to FIG. 2. In either embodiment, cooling air 50 exits the interior region 60 of the micro-truss structure 12 and forms a protective cooling film adjacent to the surface 154 of the skin material 150. Similar to transpiration cooling, a cooling air film reduces the surface temperature of the skin material 150, which is adjacent to the incident heat flux 40, and thus the amount of heat conducted through the micro-truss members. The array of cooling holes 152 in the skin material 150 can be conventionally drilled or laser machined perpendicular to, or at an angle off the normal of the surface 154. The architecture of micro-truss structure 12 can be configured such that the cooling holes 152 are located between nodes 160 of the micro-truss structure 12, enabling a predictable cooling air flow pattern.

Figure 4:
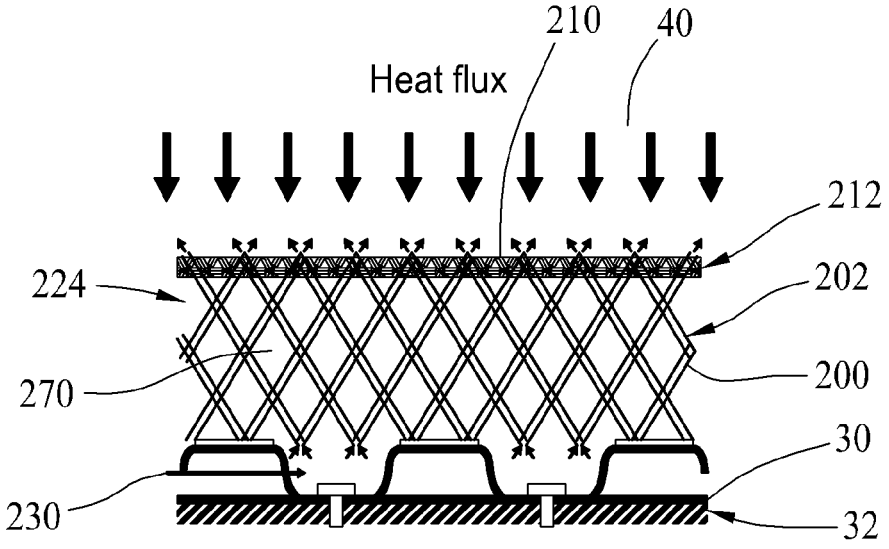
FIG. 4 is a cross sectional view of a micro-truss based actively cooled insulation layer where cooling air is directed through hollow truss members.

FIG. 4 illustrates another alternative embodiment, where film cooling can be achieved by passing cooling air 50 through hollow members 200 of a micro-truss structure 202 to a surface 210 of a skin material 212. In this embodiment, the interior 220 of the micro-truss structure 202 can optionally be filled with a highly insulating material 224, such as an aerogel. The cooling air 230 is directed into the hollow truss members 200 through separate cooling channels 230 formed between the micro-truss structure 202 and the surface 30 of the sub-structure 32 requiring thermal isolation from the high heat flux 40. The separate cooling channels 230, in one embodiment, are formed by the placement of a flow channel 240 to the surface 30 of the substructure 32 to be protected from the high heat flux. In this embodiment, a separate skin material, such as skin material 100 or skin material 150, is optional depending on the air-flow permeability and durability of the insulating material 224 filling the interior 220 of the micro-truss structure 202.

Figure 5:
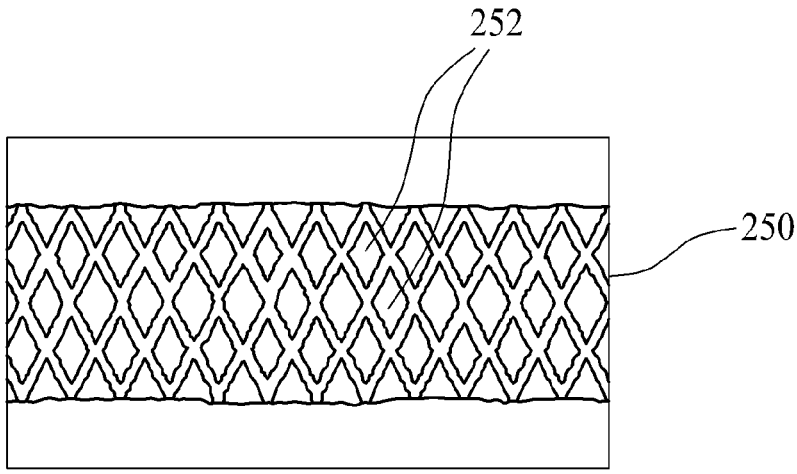
FIG. 5 is an illustration of a micro-truss structure.
Figure 6:
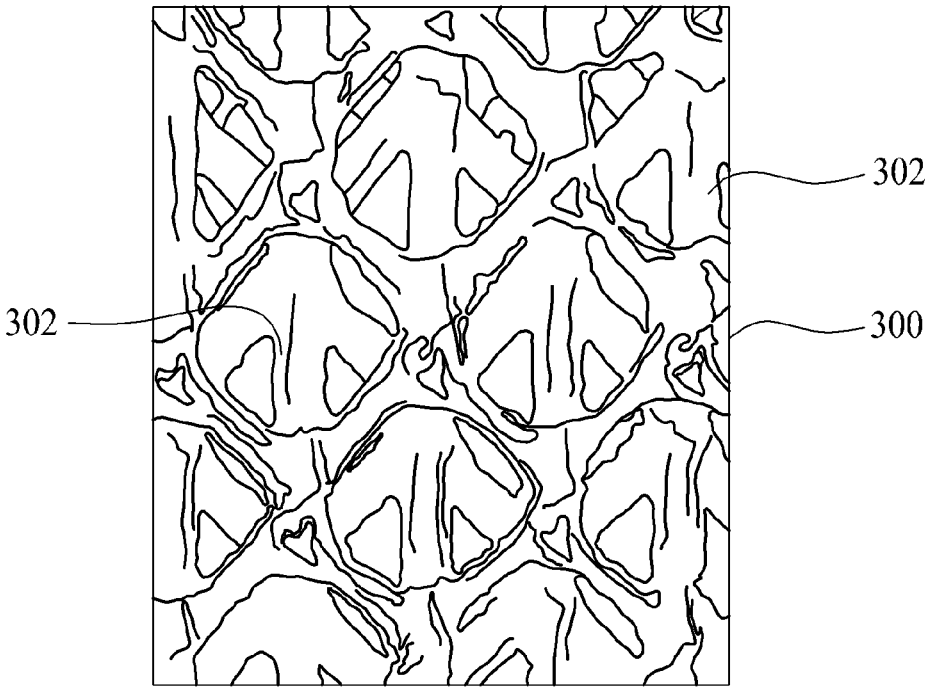
FIG. 6 is an illustration of a micro-truss structure that includes hollow truss members.
Figure 7:
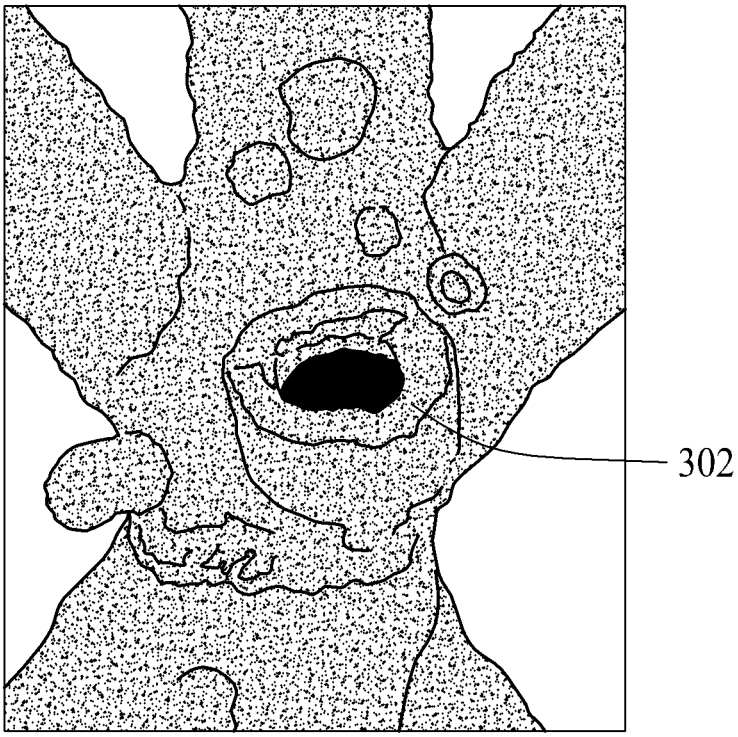
FIG. 7 is a close up view of a hollow truss member.

FIG. 5 is an illustration of one embodiment of a micro-truss structure 250 which illustrates the channels 252 through which cooling air can flow. FIG. 6 is a close up illustration of a micro-truss structure 300 that includes hollow truss members 302. FIG. 7 is a further close up view of a hollow truss member 302.

With regard to dimensions, a total thickness of the actively cooled insulation layer including one of the above described micro-truss structures 12 and 202 is between approximately 0.1 inch and two inches, in a specific embodiment. In one preferred embodiment, the thickness of the micro-truss structure ranges between 0.3 inch and one inch. The skin material ranges from about one percent to about fifty percent of the total thickness. A solid volume fraction, or relative density, of the micro-truss structure ranges between about one percent to about fifty percent.

In addition to enabling cooling flow through the structure of an actively cooled insulation layer, the micro-truss materials are utilized as a sandwich structure core material that can transfer load between the sub-structure and the skin material. This structural functionality of the micro-truss structures 12 and 202 may reduce parasitic weight of the insulation layer.

Other embodiments are contemplated that combine one or more of the features described with respect to FIGS. 1-4. For example, rather than using insulating material 224, cooling air could be routed through the hollow truss members 200 and through the interior 220 of the structure, around the micro-truss structure 202 as is described with respect to FIGS. 1-3. In addition, the optional skin may be the porous skin material 100 of FIG. 2 or the skin material 150 of FIG. 3, with the holes 152 aligning with the hollow truss members 200.

In any of the embodiments, the micro-truss structure can be optimized by changing one or more of a unit cell size, unit cell architecture, truss member diameter, and truss member angle when the micro-truss structure is grown and/or fabricated.

In one application, the described embodiments may be utilized as part of a thermal protection system for an aircraft. The described embodiments are directed to an integrated thermally resistant structure that uses a truss element to form a composite like sandwich structure to direct heat away from a surface. The truss elements are formed, in one embodiment, using developed processes that result in hollow micro-truss elements. One focus of the present disclosure is to a truss structure where a fluid flow (air) is passed though one or more of a truss structure and hollow truss members to provide cooling for surfaces that need to be protected from large thermal gradients.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus for maintaining a temperature differential between a component and a source of heat, the apparatus comprising:

a first surface and a second surface opposite the first surface, the second surface being attached to the component;

an impervious skin material comprising a plurality of holes formed therethough, the impervious skin material attached to the first surface such that the impervious skin material is disposed between the heat source and the first surface;

a truss structure comprising a plurality of hollow members, each of the plurality of hollow members comprising a first end and a second end opposite the first end, the first end of each of the plurality of hollow members extending through a respective hole of the plurality of holes formed in the impervious skin material, the plurality of hollow members further comprising a fluid flow passing from the second end of each of the plurality of hollow members and out the first end of each of the plurality of hollow members to provide film cooling at the impervious skin material; and a fluid channel formed between the second surface and the second end of each of the plurality of hollow members, the fluid channel providing the fluid flow into the plurality of hollow members through the second end of each of the plurality of hollow members.

2. The apparatus of claim 1 wherein the truss structure comprises one of a polymer, a metal, a metal alloy, and a ceramic material.

3. The apparatus of claim 1 wherein the truss structure is attached to a surface of the component using an attachment layer on said second surface as an adhesive.

4. A method for insulating a component from a source of heat that is proximate the component, the method comprising:

attaching an impervious skin material comprising a plurality of holes formed therethough to a first surface of a truss structure such that the impervious skin material is disposed between the heat source and the first surface, wherein the truss structure comprises a plurality of hollow members having a first end and a second end opposite the first end;

coupling a second surface to the component such that the second surface is opposite the first surface;

extending the first end of each of the plurality of hollow members through a respective hole of the plurality of holes formed in the impervious skin material;

forming a fluid channel between the second surface and the second end of each of the plurality of hollow members;

providing a fluid flow through the fluid channel; and providing film cooling at the impervious skin material by passing the fluid flow into the second end of each of the plurality of hollow members and out the first end of each of the plurality of hollow members.

* * * * *